US012410498B2

(12) United States Patent
Toda et al.

(10) Patent No.: US 12,410,498 B2
(45) **Date of Patent: *Sep. 9, 2025**

(54) HOT-STAMPING FORMED BODY

(71) Applicant: NIPPON STEEL CORPORATION, Tokyo (JP)

(72) Inventors: Yuri Toda, Tokyo (JP); Kodai Murasawa, Tokyo (JP); Daisuke Maeda, Tokyo (JP); Kazuo Hikida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 672 days.

This patent is subject to a terminal disclaimer.

(21) Appl. No.: 17/781,239

(22) PCT Filed: Jan. 8, 2021

(86) PCT No.: PCT/JP2021/000416

§ 371 (c)(1),
(2) Date: May 31, 2022

(87) PCT Pub. No.: WO2021/141097

PCT Pub. Date: Jul. 15, 2021

(65) Prior Publication Data

US 2023/0040050 A1 Feb. 9, 2023

(30) Foreign Application Priority Data

Jan. 9, 2020 (JP) ..... 2020-002409

(51) Int. Cl.

| | |
|---|---|
| ***C22C 38/60*** | (2006.01) |
| ***B21D 22/02*** | (2006.01) |
| ***C21D 6/00*** | (2006.01) |
| ***C21D 8/02*** | (2006.01) |
| ***C21D 9/48*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/30*** | (2006.01) |
| ***C22C 38/34*** | (2006.01) |
| ***C22C 38/38*** | (2006.01) |

(52) U.S. Cl.

CPC ..... *C22C 38/60* (2013.01); *B21D 22/022* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 9/48* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/105* (2013.01); *C22C 38/12* (2013.01); *C22C 38/14* (2013.01); *C22C 38/16* (2013.01); *C22C 38/30* (2013.01); *C22C 38/34* (2013.01); *C22C 38/38* (2013.01); *C21D 2211/001* (2013.01); *C21D 2211/002* (2013.01); *C21D 2211/008* (2013.01)

(58) Field of Classification Search

CPC ..... C22C 38/60

See application file for complete search history.

(56) References Cited

U.S. PATENT DOCUMENTS

| | | | | |
|---|---|---|---|---|
| 12,054,800 | B2 * | 8/2024 | Maeda | C23C 2/06 |
| 12,134,808 | B2 * | 11/2024 | Maeda | C22C 38/005 |
| 2014/0066763 | A2 | 3/2014 | Rothberg et al. | |
| 2014/0287263 | A1 | 9/2014 | Kawata et al. | |
| 2016/0145704 | A1 | 5/2016 | Kawasaki et al. | |
| 2018/0298462 | A1 | 10/2018 | Sano et al. | |
| 2020/0157666 | A1 | 5/2020 | Sakakibara et al. | |
| 2020/0190621 | A1 | 6/2020 | Cobo et al. | |
| 2021/0010118 | A1 * | 1/2021 | Toda | C22C 38/60 |
| 2021/0262073 | A1 | 8/2021 | Tabata et al. | |
| 2021/0292866 | A1 | 9/2021 | Yoo et al. | |
| 2022/0119911 | A1 | 4/2022 | Yl et al. | |
| 2023/0002874 | A1 | 1/2023 | Toda et al. | |
| 2023/0040050 | A1 | 2/2023 | Toda et al. | |

FOREIGN PATENT DOCUMENTS

| | | | |
|---|---|---|---|
| CN | 103874776 | B | 5/2016 |
| JP | 2017-53001 | A | 3/2017 |
| KR | 10-2019-0001492 | A | 1/2019 |
| WO | WO 2016/041159 | A1 | 3/2015 |
| WO | WO 2016/199922 | A1 | 12/2016 |
| WO | WO 2018/033960 | A1 | 2/2018 |
| WO | WO 2018/220540 | A1 | 12/2018 |
| WO | WO 2019/186930 | A1 | 10/2019 |
| WO | WO 2019/205698 | A1 | 10/2019 |
| WO | WO 2019/208556 | A1 | 10/2019 |

* cited by examiner

*Primary Examiner* — Christopher S Kessler

(74) *Attorney, Agent, or Firm* — Birch, Stewart, Kolasch & Birch, LLP

(57) ABSTRACT

A hot-stamping formed body has a predetermined chemical composition and includes microstructure which includes residual austenite of which an area ratio is in a range of 20% to 30%. Among grain boundaries of crystal grains of bainite and tempered martensite in the microstructure, a ratio of a length of a grain boundary having a rotation angle in a range of 55° to 75° to a total length of a grain boundary having a rotation angle in a range of 4° to 12°, a grain boundary having a rotation angle in a range of 49° to 54°, and a grain boundary having a rotation angle in a range of 55° to 75° to the <011> direction as a rotation axis is 30% or more.

2 Claims, 1 Drawing Sheet

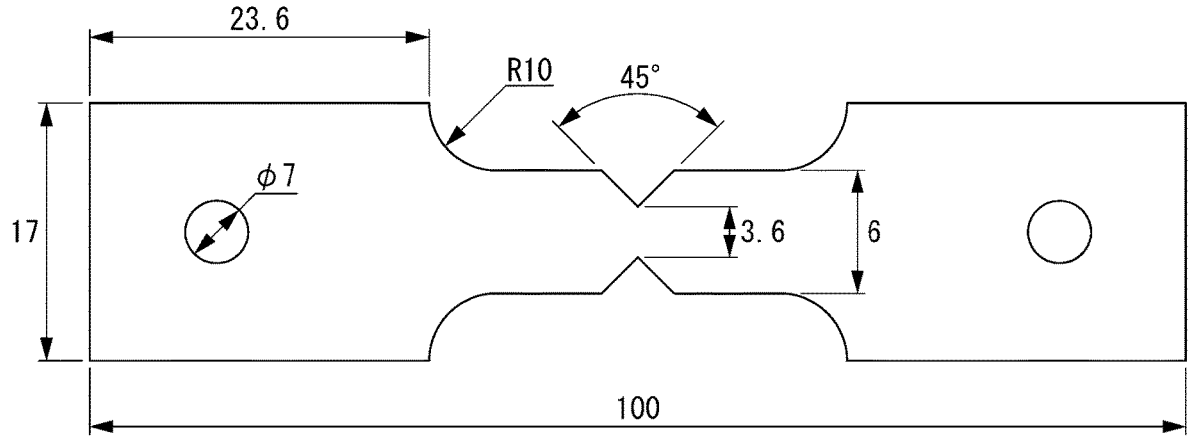
23. 6
R10
45°
ϕ7
17
3. 6
6
100

HOT-STAMPING FORMED BODY

TECHNICAL FIELD

The present invention relates to a hot-stamping formed body.

Priority is claimed on Japanese Patent Application No. 2020-002409, filed Jan. 9, 2020, the content of which is incorporated herein by reference.

BACKGROUND ART

In recent years, there has been a demand for a reduction in the weight of the vehicle body of a vehicle in terms of environmental protection and resource saving, and a high-strength steel sheet has been applied to vehicle members. Vehicle members are manufactured by press forming, but not only a forming load is increased but also the formability deteriorates as the strength of a steel sheet is increased. For this reason, the formability of a high-strength steel sheet into a member having a complicated shape becomes an issue. In order to solve this issue, the application of hot stamping technology in which press forming is performed after a steel sheet is heated up to a high temperature of an austenite range where the steel sheet softens is in progress. Hot stamping is attracting attention as technology that achieves both the formability of a steel sheet into a vehicle member and the strength of a vehicle member by performing the hardening of the steel sheet in a die at the same time as press working.

In order to obtain a higher effect of reducing the weight of a vehicle body from a vehicle member into which a steel sheet is formed by hot stamping, it is necessary to obtain a member that has high strength and is also excellent in hydrogen embrittlement resistance.

Patent Document 1 discloses a hot-dip galvanized steel sheet and a hot-dip galvannealed steel sheet that are stabilized by the concentration of C and Mn and are improved in strength, uniform deformability, and local deformability by containing 10% by volume or more of residual austenite, and methods of manufacturing the hot-dip galvanized steel sheet and the hot-dip galvannealed steel sheet.

Patent Document 2 discloses a hot-dip galvannealed steel sheet that is improved in strength, uniform deformability, and local deformability by including residual austenite of 10% by volume or more and including high-temperature tempered martensite and low-temperature tempered martensite at predetermined volume percentages.

Patent Document 3 discloses a high-strength hot press-formed member that is improved in ductility and bendability by including composite structure as the structure of steel and controlling a ratio of each structure of the composite structure.

Hydrogen embrittlement resistance is not considered in Patent Documents 1 to 3.

CITATION LIST

Patent Document

Patent Document 1: Japanese Unexamined Patent Application, First Publication No. 2017-53001

Patent Document 2: PCT International Publication No. WO2016/199922

Patent Document 3: PCT International Publication No. WO2018/033960

SUMMARY OF INVENTION

Technical Problem

An object of the present invention is to provide a hot-stamping formed body that is excellent in strength and hydrogen embrittlement resistance.

Solution to Problem

The gist of the present invention is as follows.

[1] A hot-stamping formed body according to an aspect of the present invention includes, as a chemical composition, by mass %:

C: more than 0.50% and 1.00% or less;
Si: 0.50% to 3.00%;
Mn: more than 3.00% and 5.00% or less;
Al: 0.100% to 3.000%;
Co: 0.100% to 3.000%;
P: 0.100% or less;
S: 0.1000% or less;
N: 0.0100% or less;
Nb: 0% to 0.150%;
Ti: 0% to 0.150%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and
a remainder comprising Fe and impurities; and microstructure which includes residual austenite of which an area ratio is in a range of 20% to 30%, bainite and tempered martensite of which a total area ratio is in a range of 70% to 80%, and a remainder in microstructure of which an area ratio is less than 5%, among grain boundaries of crystal grains of the bainite and the tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and a grain boundary having a rotation angle in a range of 55° to 75° to the <011> direction as a rotation axis is 30% or more.

[2] The hot-stamping formed body according to [1] may further include, as the chemical composition, by mass %, one or two or more selected from the group consisting of:

Nb: 0.010% to 0.150%;
Ti: 0.010% to 0.150%;
Mo: 0.005% to 1.00%;
Cr: 0.005% to 1.00%;
Cu: 0.001% to 1.00%;
V: 0.0005% to 1.00%;
W: 0.001% to 1.00%;
Ni: 0.001% to 3.00%;
Mg: 0.001% to 1.00%;
Zr: 0.001% to 1.00%;
Sb: 0.001% to 1.00%;
Ca: 0.001% to 0.10%;
REM: 0.001% to 0.30%; and
B: 0.0005% to 0.0100%.

Advantageous Effects of Invention

According to the aspect of the present invention, it is possible to obtain a hot-stamping formed body that is excellent in strength and hydrogen embrittlement resistance.

BRIEF DESCRIPTION OF DRAWINGS

FIG. 1 is a diagram showing a test piece that is used to evaluate the hydrogen embrittlement resistance of Example.

EMBODIMENTS OF THE INVENTION

The inventors have found that a hot-stamping formed body can be improved in hydrogen embrittlement resistance while ensuring high strength in a case where the microstructure of the hot-stamping formed body includes predetermined amounts of residual austenite and bainite and tempered martensite and a ratio of a length of a grain boundary (high angle boundary) having a rotation angle in a range of 55° to 75° to a total length of a grain boundary having a rotation angle in a range of 4° to 12°, a grain boundary having a rotation angle in a range of 49° to 54°, and a grain boundary (hereinafter, referred to as a high angle boundary) having a rotation angle in a range of 55° to 75° among grain boundaries of crystal grains of the bainite and the tempered martensite to the <011> direction as a rotation axis is set to 30% or more.

A high angle boundary is a grain boundary that has the highest angle among grain boundaries included in the crystal grains of bainite and tempered martensite. When austenite is transformed into bainite or martensite, strain associated with the transformation is generated. In a case where austenite before the transformation has high hardness or a case where prior austenite grains cannot be easily deformed, a high angle boundary, which is highly effective in relieving strain, is likely to be formed. The inventors have found that by holding the steel in a low temperature range after hot stamping, prior austenite grains are made to have high hardness, and then the prior austenite can be transformed into bainite or martensite, and many high angle boundaries can be formed.

A hot-stamping formed body according to this embodiment will be described in detail below. First, the reason why the chemical composition of the hot-stamping formed body according to this embodiment is to be limited will be described.

A limited numerical range described using "to" to be described below includes a lower limit and an upper limit. Numerical values represented using "less than" or "exceed" are not included in a numerical range. All percentages (%) related to the chemical composition mean mass %.

The hot-stamping formed body according to this embodiment includes, as a chemical composition, by mass %, C exceeding 0.50% and being 1.00% or less, 0.50% to 3.00% of Si, Mn exceeding 3.00% and being 5.00% or less, 0.100% to 3.000% of Al, 0.100% to 3.000% of Co, 0.100% or less of P, 0.1000% or less of S, 0.0100% or less of N, and a remainder comprising Fe and impurities. Each element will be described in detail below.

"C: More than 0.50% and 1.00% or Less"

C is an element that improves the strength of the hot-stamping formed body. Further, C is also an element that stabilizes residual austenite. In a case where the C content is 0.50% or less, the desired strength of the hot-stamping formed body cannot be obtained. For this reason, the C content is set to exceed 0.50%. It is preferable that the C content is 0.52% or more or 0.54% or more. On the other hand, in a case where the C content exceeds 1.00%, steel is embrittled. For this reason, the C content is set to 1.00% or less. It is preferable that the C content is 0.90% or less, 0.80% or less, or 0.70% or less.

"Si: 0.50% to 3.00%"

Si is an element that stabilizes residual austenite. In a case where the Si content is less than 0.50%, the above-mentioned effects are not obtained and the stabilization of residual austenite is insufficient. As a result, a desired amount of residual austenite cannot be obtained. For this reason, the Si content is set to 0.50% or more. The Si content is preferably 1.00% or more or 1.10% or more. On the other hand, in a case where the Si content exceeds 3.00%, the amount of ferrite is increased. As a result, a desired microstructure is not obtained. For this reason, the Si content is set to 3.00% or less. The Si content is preferably 2.50% or less or 2.00% or less.

"Mn: More than 3.00% and 5.00% or Less"

Mn is an element that facilitates bainitic transformation in a low temperature range by lowering an Ms point. In a case where the Mn content is 3.00% or less, a desired number of high angle boundaries cannot be obtained. For this reason, the Mn content is set to exceed 3.00%. The Mn content is preferably 3.10% or more or 3.20% or more. On the other hand, in a case where the Mn content exceeds 5.00%, early fracture is likely to occur. For this reason, the Mn content is set to 5.00% or less. The Mn content is preferably 4.00% or less.

"Al: 0.100% to 3.000%"

Al is an element that improves deformability by deoxidizing molten steel to suppress the formation of oxide serving as the origin of fracture. In a case where the Al content is less than 0.100%, deoxidation is not sufficiently performed and coarse oxide is generated. As a result, the above-mentioned effects are not obtained. For this reason, the Al content is set to 0.100% or more. The Al content is preferably 0.200% or more or 0.300% or more. On the other hand, in a case where the Al content exceeds 3.000%, coarse oxide is generated in steel. For this reason, the Al content is set to 3.000% or less. The Al content is preferably 2.000% or less, 1.500% or less, or 1.000% or less.

"Co: 0.100% to 3.000%"

Co is an element that facilitates bainitic transformation in a low temperature range by lowering an Ms point. In a case where the Co content is less than 0.100%, a desired amount of bainite cannot be obtained. For this reason, the Co content is set to 0.100% or more. It is preferable that the Co content is 0.110% or more or 0.120% or more. On the other hand, in a case where the Co content exceeds 3.000%, early fracture is likely to occur. For this reason, the Co content is set to 3.000% or less. It is preferable that the Co content is 2.000% or less, 1.500% or less, 1.000% or less, 0.500% or less, or 0.200% or less.

"P: 0.100% or Less"

P is an impurity element and serves as the origin of fracture by being segregated at a grain boundary. For this reason, the P content is set to 0.100% or less. The P content is preferably 0.050% or less or 0.020% or less. The lower limit of the P content is not particularly limited. However, in a case where the lower limit of the P content is reduced to less than 0.0001%, cost required to remove P is significantly increased, which is not preferable economically. For this reason, 0.0001% may be set as the lower limit of the P content in actual operation.

"S: 0.1000% or Less"

S is an impurity element and forms an inclusion in steel. Since this inclusion serves as the origin of fracture, the S content is set to 0.1000% or less. The S content is preferably 0.0500% or less, 0.0100% or less, or 0.0050% or less. The lower limit of the S content is not particularly limited. However, in a case where the lower limit of the S content is reduced to less than 0.0001%, cost required to remove S is significantly increased, which is not preferable economically. For this reason, 0.0001% may be set as the lower limit of the S content in actual operation.

"N: 0.0100% or Less"

N is an impurity element and forms nitride in steel. Since this nitride serves as the origin of fracture, the N content is set to 0.0100% or less. The N content is preferably 0.0060% or less or 0.0050% or less. The lower limit of the N content is not particularly limited. However, in a case where the lower limit of the N content is reduced to be less than 0.0001%, cost required to remove N is significantly increased, which is not preferable economically. For this reason, 0.0001% may be set as the lower limit of the N content in actual operation.

The remainder of the chemical composition of the hot-stamping formed body according to this embodiment may be Fe and impurities. Elements, which are unavoidably mixed from a steel raw material or scrap and/or during the manufacture of steel and are allowed in a range where the characteristics of the hot-stamping formed body according to this embodiment do not deteriorate, are exemplified as the impurities.

The hot-stamping formed body according to this embodiment may contain the following elements as arbitrary elements instead of a part of Fe. The contents of the following arbitrary elements, which are obtained in a case where the following arbitrary elements are not contained, are 0%.

"Nb: 0% to 0.150%"

"Ti: 0% to 0.150%"

Nb and Ti increase the ratio of a high angle boundary by refining prior austenite grains in heating before hot stamping and suppressing the deformation of prior austenite in a case where austenite is transformed into bainite or martensite. In order to reliably exert this effect, it is preferable that the content of any one of Nb and Ti is set to 0.010% or more. On the other hand, since this effect is saturated even though the content of any one of Nb and Ti exceeds 0.150%, it is preferable that each of the Nb content and the Ti content is set to 0.150% or less.

"Mo: 0% to 1.00%"

"Cr: 0% to 1.00%"

"Cu: 0% to 1.00%"

"V: 0% to 1.00%"

"W: 0% to 1.00%"

"Ni: 0% to 3.00%"

Mo, Cr, Cu, V, W, and Ni have a function to increase the strength of the hot-stamping formed body by being dissolved in prior austenite grains in the heating before hot stamping. Accordingly, it is possible to increase the ratio of a high angle boundary by suppressing the deformation of the prior austenite grains in a case where austenite is transformed into bainite or martensite. In order to reliably obtain this effect, it is preferable that any one or more of 0.005% or more of Mo, 0.005% or more of Cr, 0.001% or more of Cu, 0.0005% or more of V, 0.001% or more of W, and 0.001% or more of Ni are contained. On the other hand, since the effect is saturated even though a large amount of these elements is contained, it is preferable that each of the Mo content, the Cr content, the Cu content, the V content, and the W content is set to 1.00% or less and the Ni content is set to 3.00% or less.

"Mg: 0% to 1.00%"

"Zr: 0% to 1.00%"

"Sb: 0% to 1.00%"

"Ca: 0% to 0.10%"

"REM: 0% to 0.30%"

Mg, Zr, Sb, Ca, and REM improve deformability by suppressing the formation of oxide serving as the origin of fracture. In order to reliably obtain this effect, it is preferable that the content of even one of Mg, Zr, Sb, Ca, and REM is set to 0.001% or more. On the other hand, since the effect is saturated even though a large amount of these elements is contained, it is preferable that the Mg content, the Zr content, and the Sb content are set to 1.00% or less, the Ca content is set to 0.10% or less, and the REM content is set to 0.30% or less.

In this embodiment, REM refers to a total of 17 elements that are composed of Sc, Y, and lanthanoid and the REM content refers to the total content of these elements.

"B: 0% to 0.0100%"

B is an element that is segregated at a prior austenite grain boundary and suppresses the formation of ferrite and pearlite. In order to reliably exert this effect, it is preferable that the B content is set to 0.0005% or more. On the other hand, since the effect is saturated even though the B content exceeds 0.0100%, it is preferable that the B content is set to 0.0100% or less.

The chemical composition of the above-mentioned hot-stamping formed body may be measured by a general analysis method. For example, the chemical composition of the above-mentioned hot-stamping formed body may be measured using inductively coupled plasma-atomic emission spectrometry (ICP-AES). C and S may be measured using a combustion-infrared absorption method and N may be measured using an inert gas fusion-thermal conductivity method. In a case where a plating layer is provided on the surface of the hot-stamping formed body, the chemical composition may be analyzed after the plating layer is removed by mechanical grinding.

Next, the microstructure of the hot-stamping formed body according to this embodiment will be described.

The hot-stamping formed body according to this embodiment includes microstructure which includes residual austenite of which the area ratio is in the range of 20% to 30%, bainite and tempered martensite of which the total area ratio is in the range of 70% to 80%, and a remainder in microstructure of which the area ratio is less than 5% and in which a ratio of the length of a grain boundary having a rotation angle in the range of 55° to 75° to the total length of a grain boundary having a rotation angle in the range of 4° to 12°, a grain boundary having a rotation angle in the range of 49° to 54°, and a grain boundary (high angle boundary) having a rotation angle in the range of 55° to 75° among grain boundaries of crystal grains of the bainite and the tempered martensite to the <011> direction as a rotation axis is 30% or more.

In this embodiment, microstructure at a depth position corresponding to ¼ of a sheet thickness from the surface of the hot-stamping formed body (a region between a depth corresponding to ⅛ of the sheet thickness from the surface and a depth corresponding to ⅜ of the sheet thickness from the surface) is specified. This depth position is an intermediate point between the surface of the hot-stamping formed body and a central position of the sheet thickness, and microstructure at the depth position typifies the steel structure of the hot-stamping formed body (shows the average microstructure of the entire hot-stamping formed body).

"Residual Austenite of which the Area Ratio is in the Range of 20% to 30%"

Residual austenite improves hydrogen embrittlement resistance in the hot-stamping formed body. In a case where the area ratio of residual austenite is less than 20%, desired hydrogen embrittlement resistance cannot be obtained. For this reason, the area ratio of residual austenite is set to 20% or more. The area ratio of residual austenite is preferably 22% or more. On the other hand, in a case where the area ratio of residual austenite exceeds 30%, desired strength cannot be obtained. For this reason, the area ratio of residual austenite is set to 30% or less. The area ratio of residual austenite is preferably 27% or less.

"Bainite and Tempered Martensite of which the Total Area Ratio is in the Range of 70% to 80%"

In a case where a desired amount of bainite and tempered martensite is contained, the hydrogen embrittlement resistance of the hot-stamping formed body is improved. In a case where the total area ratio of bainite and tempered martensite is less than 70% or exceeds 80%, desired hydrogen embrittlement resistance cannot be obtained. For this reason, the total area ratio of bainite and tempered martensite is set in the range of 70% to 80%. The lower limit of the total area ratio of bainite and tempered martensite is preferably 72% or more. Further, the upper limit thereof is preferably 77% or less.

"A Remainder in Microstructure of which the Area Ratio is Less than 5%"

Fresh martensite, ferrite, pearlite, and granular bainite may be included in the microstructure of the hot-stamping formed body according to this embodiment as the remainder in microstructure. In a case where the area ratio of the remainder in microstructure is high, desired strength and desired hydrogen embrittlement resistance cannot be obtained. For this reason, the area ratio of the remainder in microstructure is set to be less than 5%. The area ratio of the remainder in microstructure is preferably 4% or less, 3% or less, 2% or less, or 1% or less.

"Measurement of the Area Ratios of Residual Austenite and Bainite and Tempered Martensite"

A sample is cut out from an arbitrary position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The size of the sample also depends on a measurement device but is set to a size that can be observed by about 10 mm in a rolling direction.

After being polished using silicon carbide paper having a grit of #600 to #1500, the cross section of the sample is finished as a mirror surface using liquid in which diamond powder having a grain size in the range of 1 μm to 6 μm is dispersed in diluted solution of alcohol or the like or pure water. Then, the sample is polished for 8 minutes using colloidal silica not containing alkaline solution at a room temperature, so that strain introduced into the surface layer of the sample is removed. A region, which has a length of 50 μm and is present between a depth corresponding to ⅛ of the sheet thickness from the surface and a depth corresponding to ⅜ of the sheet thickness from the surface, is measured at a measurement interval of 0.1 μm at an arbitrary position on the cross section of the sample in a longitudinal direction by an electron backscatter diffraction method, so that crystal orientation information is obtained. An EBSD device formed of a schottky emission scanning electron microscope (JSM-7001F manufactured by JEOL Ltd.) and an EBSD detector (DVC5 detector manufactured by TSL Solutions) is used for measurement. In this case, the degree of vacuum in the EBSD device is set to $9.6\times10^{-5}$ Pa or less, an accelerating voltage is set to 15 kV, an irradiation current level is set to 13, and the irradiation level of an electron beam is set to 62.

The area ratio of residual austenite is calculated from the obtained crystal orientation information using "Phase Map" function of software "OIM Analysis (registered trademark)" included in an EBSD analysis device. A region where a crystal structure is fcc is determined as residual austenite.

Next, regions where a crystal structure is bcc are determined as bainite, tempered martensite, fresh martensite, granular bainite, and ferrite; regions where a grain average image quality value is less than 60000 in these regions are determined as bainite, tempered martensite, and fresh martensite using "Grain Average Misorientation" function of software "OIM Analysis (registered trademark)" included in the EBSD analysis device; and the sum of the area ratios of these regions is calculated, so that the total area ratio of "bainite, tempered martensite, and fresh martensite" is obtained. The area ratio of fresh martensite, which is obtained by a method to be described later, is subtracted from the total area ratio of "bainite, tempered martensite, and fresh martensite" obtained by the above-mentioned method, so that the total area ratio of "bainite and tempered martensite" is obtained.

"Measurement of the Area Ratio of a Remainder in Microstructure"

A sample is cut out from an arbitrary position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The size of the sample also depends on a measurement device but is set to a size that can be observed by about 10 mm in a rolling direction.

After being polished using silicon carbide paper having a grit of #600 to #1500, the cross section of the sample is finished as a mirror surface using liquid in which diamond powder having a grain size in the range of 1 μm to 6 μm is dispersed in diluted solution of alcohol or the like or pure water and Nital etching is performed. Then, photographs having a plurality of visual fields are taken using a schottky emission scanning electron microscope (JSM-7001F manufactured by JEOL Ltd.) in a region that has a length of 50 μm and is present between a depth corresponding to ⅛ of the sheet thickness from the surface and a depth corresponding to ⅜ of the sheet thickness from the surface at an arbitrary position on the cross section of the sample in a longitudinal direction. Evenly spaced grids are drawn in the taken photographs, and structures at grid points are identified. The number of grid points corresponding to each structure is obtained and is divided by the total number of grid points, so that the area ratio of each structure is obtained. The area ratio can be more accurately obtained as the total number of grid points is larger. In this embodiment, grid spacings are set to 2 μm×2 μm and the total number of grid points is set to 1500.

A region where cementite is precipitated in a lamellar shape in the grains is determined as pearlite. A region where luminance is low and a substructure is not recognized is determined as ferrite. Regions where luminance is high and a substructure does not appear after etching are determined as fresh martensite and residual austenite. Regions not corresponding to any of the above-mentioned region are determined as granular bainite. The area ratio of residual austenite obtained by the above-mentioned EBSD analysis is subtracted from the area ratio of fresh martensite and residual austenite obtained from the taken photographs, so that the area ratio of fresh martensite is obtained.

"A ratio of the length of a grain boundary (high angle boundary) having a rotation angle in the range of 55° to 75° to the total length of a grain boundary having a rotation angle in the range of 4° to 12°, a grain boundary having a rotation angle in the range of 49° to 54°, and a grain boundary having a rotation angle in the range of 55° to 75° among grain boundaries of crystal grains of bainite and tempered martensite to the <011> direction as a rotation axis is 30% or more"

A high angle boundary is a grain boundary that has the highest angle among grain boundaries included in the crystal grains of bainite and tempered martensite. A high angle boundary is highly effective in suppressing the propagation of cracks caused by hydrogen. In a case where a ratio of the length of a high angle boundary is less than 30%, desired hydrogen embrittlement resistance cannot be obtained in the hot-stamping formed body. For this reason, a ratio of the length of a high angle boundary is set to 30% or more. A ratio of the length of a high angle boundary is preferably 35% or more or 40% or more. The upper limit of a ratio of the length of a high angle boundary is not particularly specified. However, according to the chemical composition and a manufacturing method according to this embodiment, a substantial upper limit thereof is 90%.

"Method of Measuring a Ratio of the Length of a High Angle Boundary"

A sample is cut out from a position away from the end surface of the hot-stamping formed body by a distance of 50 mm or more (a position that avoids the end portion in a case where the sample cannot be collected at this position) so that a cross section (sheet thickness-cross section) perpendicular to the surface can be observed. The sample also depends on a measurement device but is set to have a length that can be observed by about 10 mm in a rolling direction. A depth position of the cut-out sample corresponding to ¼ of a sheet thickness (a region between a depth corresponding to ⅛ of the sheet thickness from the surface and a depth corresponding to ⅜ of the sheet thickness from the surface) is subjected to EBSD analysis at a measurement interval of 0.1 μm, so that crystal orientation information is obtained. Here, the EBSD analysis is performed using an EBSD device formed of a schottky emission scanning electron microscope (JSM-7001F manufactured by JEOL Ltd.) and an EBSD detector (DVC5 detector manufactured by TSL Solutions) in a state where the irradiation level of an electron beam is 62.

Next, regions where a grain average image quality value is less than 60000 are determined as the crystal grains of bainite, tempered martensite, and fresh martensite with regard to the obtained crystal orientation information using "Grain Average Image Quality" function of software "OIM Analysis (registered trademark)" included in the EBSD analysis device: the length of a grain boundary having a rotation angle in the range of 4° to 12°, the length of a grain boundary having a rotation angle in the range of 49° to 54°, and the length of a grain boundary having a rotation angle in the range of 55° to 75° to the <011> direction as a rotation axis are calculated with regard to the grain boundaries of the crystal grains of bainite and tempered martensite among grain boundaries of these crystal grains; and a ratio of the length of a grain boundary having a rotation angle in the range of 55° to 75° to the value of the sum of the lengths of the respective grain boundaries is calculated. Accordingly, a ratio of the length of the grain boundary (high angle boundary) having a rotation angle in the range of 55° to 75° to the total length of the grain boundary having a rotation angle in the range of 4° to 12°, the grain boundary having a rotation angle in the range of 49° to 54°, and the grain boundary (high angle boundary) having a rotation angle in the range of 55° to 75° among the crystal grains of bainite and tempered martensite to the <011> direction as a rotation axis is obtained.

Taken photographs may be obtained by the same method as a method of measuring the area ratio of the remainder in microstructure; fresh martensite may be determined from the crystal grains of bainite, tempered martensite, and fresh martensite; and fresh martensite may be excluded from the crystal grains of bainite, tempered martensite, and fresh martensite. The reason why the grain boundaries of the crystal grains of fresh martensite are not included in the measurement of a high angle boundary is that fresh martensite has high hardness and serves as the origin of fracture.

The length of the grain boundary can be easily calculated in a case where, for example, "Inverse Pole Figure Map" function and "Axis Angle" function of software "OIM Analysis (registered trademark)" included in the EBSD analysis device are used. In these functions, among grain boundaries of crystal grains of the bainite and the tempered martensite, the total length of the grain boundaries can be calculated in a case where specific rotation angles are specified to an arbitrary direction as a rotation axis. The above-mentioned analysis may be performed over all crystal grains included in a measurement region, and the lengths of the above-mentioned three types of grain boundaries among the grain boundaries of the crystal grains of bainite and tempered martensite to the <011> direction as a rotation axis may be calculated.

"Average Dislocation Density: $4.0\times10^{15}$ m/m$^2$ or More"

The average dislocation density of the hot-stamping formed body according to this embodiment may be $4.0\times10^{15}$ m/m$^2$ or more. In a case where the hot-stamping formed body has the above-mentioned chemical composition and includes the above-mentioned microstructure, that is, residual austenite of which the area ratio is in the range of 20% to 30%, bainite and tempered martensite of which the total area ratio is in the range of 70% to 80%, and a remainder in microstructure of which the area ratio is less than 5% and in which a ratio of the length of a grain boundary having a rotation angle in the range of 55° to 75° to the total length of a grain boundary having a rotation angle in the range of 4° to 12°, a grain boundary having a rotation angle in the range of 49° to 54°, and a grain boundary having a rotation angle in the range of 55° to 75° among grain boundaries of crystal grains of the bainite and the tempered martensite to the <011> direction as a rotation axis is 30% or more, the average dislocation density of the hot-stamping formed body may be $4.0\times10^{15}$ m/m$^2$ or more.

"Measurement of Average Dislocation Density"

A sample is cut out from an arbitrary position away from an end surface of the hot-stamping formed body by a distance of 50 mm or more (a position that avoids an end portion in a case where the sample cannot be collected at this position). The size of the sample also depends on a measurement device but is set to a size that corresponds to about 20 mm square. The thickness of the sample is reduced using a mixed solution that is composed of 48% by volume of distilled water, 48% by volume of hydrogen peroxide solution, and 4% by volume of hydrofluoric acid. In this case, the same thickness is reduced from each of the surface and back of the sample, so that a depth position corresponding to ¼ of the sheet thickness (a region between a depth corresponding to ⅛ of the sheet thickness from the surface and a depth corresponding to ⅜ of the Sheet Thickness from the Surface) is Exposed from the Surface of the Sample not depressurized. X-ray diffraction measurement is performed on this exposed surface to specify a plurality of diffraction peaks of a body-centered cubic lattice. An average dislocation density is analyzed from the half-widths of these diffraction peaks, so that the average dislocation density of a surface layer region is obtained. A modified Williamson-Hall method disclosed in "T. Ungar, three others, Journal of Applied Crystallography, 1999, Vol. 32, pp. 992 to 1002" is used as an analysis method.

"Lath Width of Crystal Grains Having Body-Centered Structure: 200 nm or Less"

The lath width of crystal grains, which have body-centered structure, of the hot-stamping formed body according to this embodiment may be 200 nm or less. In a case where the hot-stamping formed body has the above-mentioned chemical composition and includes the above-mentioned microstructure, that is, residual austenite of which the area ratio is in the range of 20% to 30%, bainite and tempered martensite of which the total area ratio is in the range of 70% to 80%, and a remainder in microstructure of which the area ratio is less than 5%, among grain boundaries of crystal grains of the bainite and the tempered martensite, a ratio of the length of a grain boundary having a rotation angle in the range of 55° to 75° to the total length of a grain boundary having a rotation angle in the range of 4° to 12°, a grain boundary having a rotation angle in the range of 49° to 54°, and a grain boundary having a rotation angle in the range of 55° to 75° to the <011> direction as a rotation axis is 30% or more, the lath width of crystal grains having body-centered structure is inevitability 200 nm or less.

In a case where the lath width of crystal grains having body-centered structure is 200 nm or less, an effect of refining crystal grains is obtained. Accordingly, desired tensile strength can be obtained. Preferably, the lath width is 180 nm or less. Since it is more preferable as the lath width is smaller, the lower limit of the lath width is not particularly specified.

"Measurement of Lath Width of Crystal Grains Having Body-Centered Structure"

A sample is cut out from a position away from the end surface of the hot-stamping formed body by a distance of 50 mm or more (a position that avoids the end portion in a case where the sample cannot be collected at this position) so that a cross section (sheet thickness-cross section) perpendicular to the surface can be observed. The sample also depends on a measurement device but is set to have a length that can be observed by about 10 mm in a rolling direction. A depth position of the cut-out sample corresponding to ¼ of a sheet thickness (a region between a depth corresponding to ⅛ of the sheet thickness from the surface and a depth corresponding to ⅜ of the sheet thickness from the surface) is subjected to EBSD analysis at a measurement interval of 0.1 μm, so that crystal orientation information is obtained. Here, the EBSD analysis is performed using an EBSD device formed of a schottky emission scanning electron microscope (JSM-7001F manufactured by JEOL Ltd.) and an EBSD detector (DVC5 detector manufactured by TSL Solutions) in a state where the irradiation level of an electron beam is 62.

Next, an Invere Pole Figure image of only crystal grains having body-centered structure is drawn with regard to the obtained crystal orientation information using "Invere Pole Figure" function of software "OIM Analysis (registered trademark)" included in the EBSD analysis device, crystal grains of which a difference in crystal orientation is 8° or less is regarded as one lath (generally, called a block but expressed as a lath in this embodiment), and the length of the lath in a minor axis direction is measured. The lengths of 20 or more laths in the minor axis direction are measured and an average value of the lengths is calculated, so that the lath width of the crystal grains having body-centered structure is obtained.

"Sheet Thickness and Tensile Strength"

The sheet thickness of the hot-stamping formed body according to this embodiment is not particularly limited. However, in terms of reducing the weight of a vehicle body, it is preferable that the sheet thickness of the hot-stamping formed body according to this embodiment is set in the range of 0.5 mm to 3.5 mm. Further, in terms of reducing the weight of a vehicle body, it is preferable that the tensile strength of the hot-stamping formed body is set to 1500 MPa or more. More preferably, the tensile strength of the hot-stamping formed body is 1800 MPa or more or 2000 MPa or more. The upper limit of the tensile strength is not particularly specified, but may be set to 2600 MPa or less.

"Plating Layer"

For the purpose of improving corrosion resistance and the like, a plating layer may be formed on the surface of the hot-stamping formed body according to this embodiment. The plating layer may be any of an electroplating layer and a hot-dip plating layer. The electroplating layer includes, for example, an electrogalvanized layer, an electrolytic Zn—Ni alloy plating layer, and the like. The hot-dip plating layer includes, for example, a hot-dip galvanized layer, a hot-dip galvannealed layer, a hot-dip aluminum plating layer, a hot-dip Zn—Al alloy plating layer, a hot-dip Zn—Al—Mg alloy plating layer, a hot-dip Zn—Al—Mg—Si alloy plating layer, and the like. The adhesion amount of a plating layer is not particularly limited and may be a general adhesion amount.

"Method of Manufacturing a Hot-Stamping Formed Body"

Next, a preferred method of manufacturing the hot-stamping formed body according to this embodiment will be described.

The hot-stamping formed body according to this embodiment can be manufactured by performing hot stamping on a cold-rolled steel sheet manufactured by a routine method or a cold-rolled steel sheet including a plating layer on the surface thereof, holding the cold-rolled steel sheet in a low temperature range after the hot stamping, and then cooling the cold-rolled steel sheet.

"Heating and Holding Before Hot Stamping"

It is preferable that the cold-rolled steel sheet is held for 60 sec to 600 sec in the temperature range of 800° C. to 1000° C. before the hot stamping. In a case where a heating temperature is lower than 800° C. or a holding time is less than 60 sec, the cold-rolled steel sheet cannot be sufficiently austenitized. For this reason, a desired amount of bainite and tempered martensite may not be capable of being obtained in the hot-stamping formed body. In a case where a heating temperature exceeds 1000° C. or a holding time exceeds 600 sec, transformation into bainite and tempered martensite is delayed due to an increase in austenite grain size. For this reason, a desired amount of bainite and tempered martensite may not be capable of being obtained.

An average heating rate during the heating may be set to 0.1° C./s or more or 200° C./s or less. An average heating rate mentioned here is a value that is obtained in a case where a temperature difference between the surface temperature of a steel sheet at the time of start of the heating and a holding temperature is divided by a time difference from the start of the heating to a time when a temperature reaches a holding temperature. Further, during the holding, the temperature of a steel sheet may be fluctuated in the temperature range of 800° C. to 1000° C. or may be constant.

Examples of a heating method before the hot stamping include heating using an electric furnace, a gas furnace, or the like, flame heating, energization heating, high-frequency heating, induction heating, and the like.

"Cooling after Hot Stamping"

Hot stamping is performed after the heating and the holding described above. After the hot stamping, it is preferable that cooling is performed at an average cooling rate of 1.0° C./s to 100° C./s up to the temperature range of 150° C. to 300° C. In a case where a cooling stop temperature is lower than 150° C. in the cooling after the hot stamping, the introduction of lattice defects is excessively facilitated. For this reason, desired dislocation density may not be capable of being obtained. In a case where a cooling stop temperature exceeds 300° C., the hardness of prior austenite grains is reduced. For this reason, a desired number of high angle boundaries may not be capable of being formed. Further, in a case where an average cooling rate is lower than 1.0° C./s, transformation into ferrite, granular bainite, or pearlite is facilitated. For this reason, a desired amount of bainite and tempered martensite may not be capable of being obtained. In a case where an average cooling rate exceeds 100° C./s, the driving force of transformation into tempered martensite and bainite is increased and an action for relieving strain to be introduced by transformation is reduced. For this reason, it is difficult to obtain a desired number of high angle boundaries. An average cooling rate mentioned here is a value of the difference in the surface temperatures between at the cooling start and at the cooling end divided by time difference between the cooling start and the cooling end.

"Holding at Low Temperature"

It is preferable that holding at low temperature is performed in the temperature range of 150° C. to 300° C. for a period exceeding 50 hours and equal to or shorter than 20 days. During the holding at low temperature carbon is distributed to untransformed austenite from martensite that is transformed from austenite. Austenite on which carbon is concentrated is not transformed into martensite and remains as residual austenite even after the finish of cooling after the holding at low temperature. Further, since austenite in which carbon is concentrated has high hardness in a case where holding at low temperature is performed under the above-mentioned conditions, the ratio of a high angle boundary can be increased.

In a case where a holding temperature is lower than 150° C. or a holding time is 50 hours or less, carbon is not sufficiently distributed to untransformed austenite from martensite. For this reason, a desired amount of residual austenite may not be capable of being obtained. Further, the ratio of a high angle boundary is reduced. In a case where a holding temperature exceeds 300° C., the hardness of prior austenite is reduced. For this reason, a desired number of high angle boundaries may not be capable of being obtained. Even though a holding time exceeds 20 days, the distribution behavior of carbon is saturated and desired microstructure cannot be obtained. For this reason, the upper limit of a holding time is set to 20 days. During the holding at low temperature, the temperature of a steel sheet may be fluctuated in the temperature range of 150° C. to 300° C. or may be constant.

The holding at low temperature is not particularly limited, but may be performed with a steel sheet after the hot stamping transported to a heating furnace.

In a case where the steel sheet is heated in the temperature range of 300° C. or more after hot stamping and cooling and before holding at low temperature, bainite is generated. As a result, a desired number of high angle boundaries cannot be obtained. For this reason, in a case where the hot-stamping formed body according to this embodiment is to be manufactured, it is not preferable that the steel sheet is heated in the temperature range of 300° C. or more after hot stamping and cooling and before holding at low temperature.

"Cooling after Holding at Low Temperature"

It is preferable that the steel sheet is cooled up to a temperature of 80° C. or less at an average cooling rate of 1.0° C./s to 100° C./s after the holding at low temperature. In a case where an average cooling rate is lower than 1.0° C./s or a cooling stop temperature exceeds 80° C., residual austenite may be decomposed. For this reason, a desired amount of residual austenite may not be capable of being obtained. In a case where an average cooling rate exceeds 100° C./s, a load is applied to a cooling device. An average cooling rate mentioned here is a value of the difference in the surface temperatures between at the time of start of the cooling after the holding at low temperature and at the time of end of the cooling divided by time difference between the cooling start and the cooling end.

Examples

Next, examples of the present invention will be described. Conditions in the examples are one condition example that is employed to confirm the feasibility and effects of the present invention, and the present invention is not limited to this condition example. The present invention may employ various conditions to achieve the object of the present invention without departing from the scope of the present invention.

Hot rolling and cold rolling were performed on steel pieces manufactured by the casting of molten steel having the chemical composition shown in Tables 1 and 2, and plating was performed on the steel pieces as necessary, so that cold-rolled steel sheets were obtained. Then, hot-stamping formed bodies shown in Tables 3 and 4 were manufactured using the cold-rolled steel sheets under conditions shown in Tables 3 and 4.

An average heating rate during heating before hot stamping was set to 0.1° C./s to 200° C./s, cooling after hot stamping was performed up to the temperature range of 150° C. to 300° C., and cooling after holding at low temperature was performed up to a temperature of 80° C. or less. Further, Manufacture No. 18 of Table 3 was provided with a hot-dip aluminum plating layer and Manufacture No. 19 was provided with a hot-dip galvanized layer.

Manufacture No. 57 was held for 30 sec in the temperature range of 300 to 560° after hot stamping and cooling and before holding at low temperature, and was then subjected to holding at low temperature shown in Table 4.

An underline in Tables represents that a condition is out of the range of the present invention, a condition is out of a preferred manufacturing condition, or a characteristic value is not preferred. γr in Tables 3 and 4 denotes residual austenite, B denotes bainite, and TM denotes tempered martensite.

With regard to the microstructure of the hot-stamping formed body, the measurement of the area ratio of each structure, the measurement of a ratio of the length of a high angle boundary, the measurement of dislocation density, and the measurement of the lath width of crystal grains having body-centered structure were performed by the above-mentioned measurement methods. Further, the mechanical characteristics of the hot-stamping formed body were evaluated by the following methods.

"Tensile Strength"

No. 5 test pieces described in JIS Z 2241:2011 were prepared from an arbitrary position of the hot-stamping formed body, and the tensile strength of the hot-stamping formed body was obtained according to a test method described in JIS Z 2241:2011. The speed of a cross-head was set to 3 mm/min. The test piece was determined to be acceptable since being excellent in strength in a case where tensile strength was 1500 MPa or more, and was determined to be unacceptable since being inferior in strength in a case where tensile strength was less than 1500 MPa.

"Hydrogen Embrittlement Resistance"

The hydrogen embrittlement resistance of the hot-stamping formed body was evaluated by the following method. The shape of a test piece used to evaluate hydrogen embrittlement resistance is shown in FIG. 1. A test piece of FIG. 1 provided with V-notches was immerged in an aqueous solution, in which 5 g/l of ammonium thiocyanate was dissolved in 3% by volume of saline solution, for 12 hours at a room temperature; and it was determined whether or not fracture occurs. The test piece was determined to be acceptable in a case where fracture did not occur even though the test piece was immerged for 12 hours or more; and was written as "Fair" in a case where fracture did not occur after 12 hours, was written as "Good" in a case where fracture did not occur after 18 hours, and was written as "Very Good" in a case where fracture did not occur after 24 hours in Tables 3 and 4. The test piece was determined to be unacceptable in a case where fracture occurred after 12 hours; and was written as "Bad" in Tables 3 and 4.

It is found from Tables 3 and 4 that a hot-stamping formed body of which the chemical composition and the microstructure are in the range of the present invention has excellent strength and hydrogen embrittlement resistance.

On the other hand, it is found that a hot-stamping formed body of which any one or more of the chemical composition and the microstructure is out of the present invention is inferior in one or more of strength and hydrogen embrittlement resistance.

TABLE 1

| Steel | Chemical composition (mass %) Remainder Fe and impurities | | | | | | | | | |
|---|---|---|---|---|---|---|---|---|---|---|
| No. | C | Si | Mn | Al | Co | P | S | N | Others | Note |
| 1 | 0.51 | 1.75 | 3.53 | 0.442 | 0.104 | 0.005 | 0.0020 | 0.0042 | | Steel of invention |
| 2 | 0.87 | 1.02 | 3.35 | 0.315 | 0.105 | 0.007 | 0.0007 | 0.0050 | | Steel of invention |
| 3 | 0.56 | 0.66 | 3.30 | 0.313 | 0.111 | 0.004 | 0.0021 | 0.0033 | | Steel of invention |
| 4 | 0.53 | 2.89 | 3.37 | 0.536 | 0.112 | 0.006 | 0.0029 | 0.0052 | | Steel of invention |
| 5 | 0.54 | 1.85 | 3.12 | 0.368 | 0.103 | 0.012 | 0.0020 | 0.0035 | | Steel of invention |
| 6 | 0.56 | 0.95 | 4.78 | 0.507 | 0.126 | 0.007 | 0.0023 | 0.0036 | | Steel of invention |
| 7 | 0.54 | 1.01 | 3.37 | 0.120 | 0.103 | 0.003 | 0.0028 | 0.0051 | | Steel of invention |
| 8 | 0.54 | 1.83 | 3.29 | 2.780 | 0.110 | 0.009 | 0.0007 | 0.0040 | | Steel of invention |
| 9 | 0.53 | 1.87 | 3.36 | 0.340 | 0.181 | 0.086 | 0.0019 | 0.0052 | | Steel of invention |
| 10 | 0.54 | 1.08 | 3.17 | 0.402 | 2.781 | 0.087 | 0.0024 | 0.0035 | | Steel of invention |
| 11 | 0.56 | 1.66 | 3.16 | 0.743 | 0.123 | 0.082 | 0.0021 | 0.0028 | | Steel of invention |
| 12 | 0.55 | 1.64 | 3.38 | 0.673 | 0.112 | 0.001 | 0.0015 | 0.0047 | | Steel of invention |
| 13 | 0.51 | 1.21 | 3.24 | 0.804 | 0.143 | 0.006 | 0.0781 | 0.0030 | | Steel of invention |
| 14 | 0.51 | 1.07 | 3.26 | 0.622 | 0.112 | 0.006 | 0.0004 | 0.0051 | | Steel of invention |
| 15 | 0.54 | 1.56 | 3.13 | 0.481 | 0.116 | 0.011 | 0.0016 | 0.0072 | | Steel of invention |
| 16 | 0.54 | 1.22 | 3.34 | 0.427 | 0.128 | 0.003 | 0.0033 | 0.0003 | | Steel of invention |
| 17 | 0.51 | 1.70 | 3.35 | 0.462 | 0.151 | 0.005 | 0.0025 | 0.0031 | | Steel of invention |
| 18 | 0.56 | 1.47 | 3.26 | 0.436 | 0.122 | 0.005 | 0.0025 | 0.0034 | | Steel of invention |
| 19 | 0.51 | 1.53 | 3.31 | 0.444 | 0.125 | 0.004 | 0.0024 | 0.0030 | | Steel of invention |
| 20 | 0.54 | 1.77 | 3.19 | 0.502 | 0.127 | 0.009 | 0.0031 | 0.0045 | Nb: 0.037 | Steel of invention |
| 21 | 0.53 | 1.16 | 3.45 | 0.784 | 0.142 | 0.004 | 0.0012 | 0.0032 | Ti: 0.016 | Steel of invention |
| 22 | 0.55 | 1.03 | 3.21 | 0.403 | 0.113 | 0.009 | 0.0018 | 0.0053 | Mo: 0.12 | Steel of invention |
| 23 | 0.51 | 1.54 | 3.40 | 0.662 | 0.154 | 0.011 | 0.0017 | 0.0031 | Cr: 0.21 | Steel of invention |
| 24 | 0.55 | 1.76 | 3.26 | 0.754 | 0.147 | 0.012 | 0.0020 | 0.0044 | Cu: 0.23 | Steel of invention |
| 25 | 0.55 | 1.55 | 3.33 | 0.331 | 0.149 | 0.005 | 0.0014 | 0.0033 | V: 0.24 | Steel of invention |

TABLE 2

| Steel | Chemical composition (mass %) Remainder Fe and impurities | | | | | | | | | |
|---|---|---|---|---|---|---|---|---|---|---|
| No. | C | Si | Mn | Al | Co | P | S | N | Others | Note |
| 26 | 0.51 | 1.61 | 3.16 | 0.416 | 0.140 | 0.005 | 0.0024 | 0.0030 | W: 0.25 | Steel of invention |
| 27 | 0.55 | 1.47 | 3.47 | 0.351 | 0.125 | 0.011 | 0.0028 | 0.0026 | Ni: 0.29 | Steel of invention |
| 28 | 0.53 | 1.41 | 3.33 | 0.452 | 0.149 | 0.009 | 0.0029 | 0.0037 | Mg: 0.03 | Steel of invention |
| 29 | 0.52 | 1.62 | 3.17 | 0.373 | 0.113 | 0.012 | 0.0024 | 0.0050 | Zr: 0.02 | Steel of invention |
| 30 | 0.52 | 1.69 | 3.14 | 0.563 | 0.112 | 0.005 | 0.0018 | 0.0045 | Sb: 0.01 | Steel of invention |
| 31 | 0.54 | 1.44 | 3.37 | 0.499 | 0.125 | 0.011 | 0.0026 | 0.0030 | B: 0.0023 | Steel of invention |

TABLE 2-continued

| Steel | Chemical composition (mass %) Remainder Fe and impurities | | | | | | | | | |
|---|---|---|---|---|---|---|---|---|---|---|
| No. | C | Si | Mn | Al | Co | P | S | N | Others | Note |
| 32 | 0.51 | 1.43 | 3.18 | 0.412 | 0.136 | 0.009 | 0.0028 | 0.0032 | Ca: 0.02 | Steel of invention |
| 33 | 0.54 | 1.22 | 3.50 | 0.421 | 0.124 | 0.009 | 0.0017 | 0.0035 | REM: 0.13 | Steel of invention |
| 34 | 0.35 | 1.11 | 3.38 | 0.777 | 0.135 | 0.008 | 0.0025 | 0.0043 | | Comparative steel |
| 35 | 1.10 | 1.53 | 3.47 | 0.492 | 0.118 | 0.005 | 0.0008 | 0.0028 | | Comparative steel |
| 36 | 0.56 | 0.24 | 3.49 | 0.732 | 0.108 | 0.010 | 0.0027 | 0.0041 | | Comparative steel |
| 37 | 0.55 | 3.30 | 3.16 | 0.596 | 0.150 | 0.010 | 0.0007 | 0.0046 | | Comparative steel |
| 38 | 0.51 | 1.11 | 2.88 | 0.312 | 0.129 | 0.005 | 0.0009 | 0.0046 | | Comparative steel |
| 39 | 0.56 | 1.59 | 5.19 | 0.413 | 0.100 | 0.005 | 0.0020 | 0.0043 | | Comparative steel |
| 40 | 0.53 | 1.21 | 3.45 | 0.070 | 0.129 | 0.011 | 0.0019 | 0.0045 | | Comparative steel |
| 41 | 0.55 | 1.07 | 3.16 | 3.220 | 0.107 | 0.006 | 0.0020 | 0.0050 | | Comparative steel |
| 42 | 0.52 | 1.35 | 3.37 | 0.320 | 0.060 | 0.006 | 0.0020 | 0.0046 | | Comparative steel |
| 43 | 0.53 | 1.10 | 3.27 | 0.460 | 3.223 | 0.006 | 0.0020 | 0.0049 | | Comparative steel |
| 44 | 0.54 | 1.83 | 3.30 | 0.606 | 0.143 | 0.212 | 0.0010 | 0.0050 | | Comparative steel |
| 45 | 0.53 | 1.11 | 3.38 | 0.462 | 0.105 | 0.008 | 0.1803 | 0.0030 | | Comparative steel |
| 46 | 0.51 | 1.11 | 3.48 | 0.460 | 0.117 | 0.007 | 0.0027 | 0.0213 | | Comparative steel |

An underline represents that a condition is out of the range of the present invention.

TABLE 3

| | | Heating | | Cooling after HS Average cooling rate until holding | Holding at low temperature | | Cooling after holding at low temperature | |
|---|---|---|---|---|---|---|---|---|
| Manufacture No. | Steel No. | Heating temperature (° C.) | Holding time (s) | at low temperature (° C./s) | Holding temperature (° C.) | Holding time (h) | Average cooling rate (° C./s) | Microstructure γr (area %) |
| 1 | 1 | 910 | 310 | 5 | 189 | 265 | 5 | 24 |
| 2 | 2 | 896 | 377 | 9 | 181 | 243 | 16 | 26 |
| 3 | 3 | 891 | 351 | 9 | 205 | 280 | 10 | 21 |
| 4 | 4 | 883 | 249 | 8 | 210 | 214 | 20 | 25 |
| 5 | 5 | 918 | 354 | 4 | 188 | 274 | 12 | 27 |
| 6 | 6 | 894 | 232 | 4 | 183 | 292 | 20 | 24 |
| 7 | 7 | 923 | 360 | 9 | 192 | 232 | 9 | 27 |
| 8 | 8 | 898 | 311 | 5 | 185 | 242 | 19 | 25 |
| 9 | 9 | 890 | 366 | 10 | 182 | 250 | 13 | 22 |
| 10 | 10 | 890 | 310 | 3 | 180 | 211 | 19 | 25 |
| 11 | 11 | 938 | 328 | 6 | 207 | 227 | 19 | 23 |
| 12 | 12 | 889 | 312 | 8 | 207 | 240 | 16 | 22 |
| 13 | 13 | 925 | 234 | 4 | 200 | 251 | 11 | 23 |
| 14 | 14 | 896 | 257 | 8 | 200 | 268 | 11 | 23 |
| 15 | 15 | 928 | 346 | 8 | 180 | 267 | 20 | 27 |
| 16 | 16 | 938 | 253 | 10 | 194 | 257 | 12 | 26 |
| 17 | 17 | 889 | 248 | 7 | 207 | 208 | 6 | 22 |
| 18 | 18 | 894 | 323 | 10 | 199 | 287 | 8 | 22 |
| 19 | 19 | 896 | 318 | 9 | 208 | 280 | 15 | 23 |
| 20 | 20 | 918 | 346 | 7 | 195 | 257 | 15 | 26 |
| 21 | 21 | 912 | 241 | 6 | 194 | 209 | 9 | 22 |
| 22 | 22 | 922 | 347 | 4 | 193 | 226 | 11 | 26 |
| 23 | 23 | 904 | 314 | 3 | 203 | 204 | 10 | 26 |
| 24 | 24 | 891 | 260 | 8 | 201 | 208 | 15 | 25 |
| 25 | 25 | 881 | 319 | 5 | 180 | 259 | 10 | 22 |
| 26 | 26 | 927 | 343 | 6 | 182 | 252 | 12 | 23 |
| 27 | 27 | 937 | 254 | 5 | 189 | 233 | 15 | 23 |
| 28 | 28 | 892 | 298 | 5 | 197 | 284 | 7 | 23 |
| 29 | 29 | 913 | 267 | 9 | 209 | 205 | 10 | 25 |
| 30 | 30 | 882 | 293 | 3 | 204 | 252 | 5 | 26 |

TABLE 3-continued

| | Microstructure | | | | | Mechanical characteristics | | |
|---|---|---|---|---|---|---|---|---|
| Manufacture No. | B + TM (area %) | Remainder (area %) | Ratio of length of grain boundary having rotation angle in range of 55° to 75° (%) | Dislocation density ($10^{15}$ m/m$^2$) | Lath width (nm) | Tensile strength (MPa) | Hydrogen embrittlement resistance | Note |
| 1 | 74 | 2 | 55 | 4.4 | 189 | 1530 | Good | Example of invention |
| 2 | 73 | 1 | 44 | 7.3 | 151 | 2509 | Good | Example of invention |
| 3 | 76 | 3 | 50 | 5.9 | 166 | 2149 | Fair | Example of invention |
| 4 | 71 | 4 | 49 | 6.3 | 180 | 2363 | Fair | Example of invention |
| 5 | 71 | 2 | 34 | 5.6 | 176 | 2427 | Fair | Example of invention |
| 6 | 72 | 4 | 40 | 6.4 | 165 | 2231 | Fair | Example of invention |
| 7 | 72 | 1 | 55 | 6.2 | 176 | 2401 | Fair | Example of invention |
| 8 | 71 | 4 | 40 | 4.9 | 171 | 2135 | Fair | Example of invention |
| 9 | 74 | 4 | 51 | 5.8 | 162 | 2275 | Fair | Example of invention |
| 10 | 73 | 2 | 49 | 5.6 | 163 | 2128 | Fair | Example of invention |
| 11 | 74 | 3 | 51 | 6.1 | 165 | 2130 | Fair | Example of invention |
| 12 | 74 | 4 | 47 | 6.1 | 187 | 2409 | Very Good | Example of invention |
| 13 | 73 | 4 | 51 | 6.2 | 171 | 2489 | Fair | Example of invention |
| 14 | 74 | 3 | 41 | 5.4 | 180 | 2396 | Very Good | Example of invention |
| 15 | 70 | 3 | 51 | 6.2 | 186 | 2125 | Fair | Example of invention |
| 16 | 70 | 4 | 52 | 5.4 | 175 | 2444 | Very Good | Example of invention |
| 17 | 75 | 3 | 47 | 4.6 | 186 | 2388 | Very Good | Example of invention |
| 18 | 75 | 3 | 51 | 4.8 | 176 | 2360 | Very Good | Example of invention |
| 19 | 73 | 4 | 51 | 4.5 | 164 | 2499 | Very Good | Example of invention |
| 20 | 70 | 4 | 43 | 6.0 | 161 | 2344 | Very Good | Example of invention |
| 21 | 76 | 2 | 40 | 6.4 | 170 | 2269 | Very Good | Example of invention |
| 22 | 70 | 4 | 41 | 6.3 | 165 | 2049 | Very Good | Example of invention |
| 23 | 70 | 4 | 50 | 6.2 | 178 | 2443 | Very Good | Example of invention |
| 24 | 72 | 3 | 53 | 4.9 | 161 | 2491 | Very Good | Example of invention |
| 25 | 76 | 2 | 52 | 4.7 | 174 | 2193 | Very Good | Example of invention |
| 26 | 75 | 2 | 46 | 6.4 | 184 | 2069 | Very Good | Example of invention |
| 27 | 73 | 4 | 56 | 4.9 | 190 | 2218 | Very Good | Example of invention |
| 28 | 76 | 1 | 43 | 4.7 | 161 | 2273 | Very Good | Example of invention |
| 29 | 71 | 4 | 46 | 6.1 | 162 | 2208 | Very Good | Example of invention |
| 30 | 72 | 2 | 52 | 5.1 | 173 | 2348 | Very Good | Example of invention |

TABLE 4

| | | Heating | | Cooling after HS Average cooling | Holding at low temperature | | Cooling after holding at low temperature | |
|---|---|---|---|---|---|---|---|---|
| Manufacture No. | Steel No. | Heating temperature (° C.) | Holding time (s) | rate until holding at low temperature (° C./s) | Holding temperature (° C.) | Holding time (h) | Average cooling rate (° C./s) | Microstructure γr (area %) |
| 31 | 31 | 933 | 302 | 7 | 199 | 294 | 17 | 23 |
| 32 | 32 | 888 | 336 | 3 | 200 | 294 | 14 | 22 |
| 33 | 33 | 938 | 260 | 6 | 197 | 215 | 7 | 26 |
| 34 | 34 | 938 | 270 | 7 | 203 | 210 | 10 | 23 |
| 35 | 35 | 940 | 349 | 8 | 183 | 227 | 7 | 24 |
| 36 | 36 | 911 | 283 | 10 | 198 | 270 | 6 | 16 |
| 37 | 37 | 888 | 284 | 10 | 184 | 300 | 20 | 27 |
| 38 | 38 | 923 | 284 | 4 | 189 | 202 | 11 | 26 |
| 39 | 39 | 917 | 345 | 6 | 191 | 209 | 16 | 28 |
| 40 | 40 | 932 | 250 | 8 | 181 | 284 | 15 | 24 |
| 41 | 41 | 901 | 357 | 5 | 181 | 231 | 18 | 24 |
| 42 | 42 | 921 | 362 | 6 | 204 | 232 | 17 | 24 |
| 43 | 43 | 898 | 284 | 9 | 194 | 259 | 16 | 23 |
| 44 | 44 | 926 | 310 | 4 | 201 | 242 | 13 | 28 |
| 45 | 45 | 902 | 305 | 7 | 183 | 231 | 7 | 23 |
| 46 | 46 | 880 | 255 | 7 | 201 | 296 | 17 | 28 |
| 47 | 17 | 782 | 373 | 5 | 194 | 25 | 13 | 17 |
| 48 | 17 | 1084 | 381 | 11 | 202 | 28 | 18 | 20 |
| 49 | 17 | 911 | 45 | 6 | 194 | 25 | 11 | 19 |
| 50 | 17 | 931 | 124 | 11 | 207 | 30 | 6 | 19 |
| 51 | 17 | 941 | 251 | 0.5 | 209 | 31 | 19 | 19 |
| 52 | 17 | 889 | 277 | 111 | 203 | 22 | 20 | 19 |
| 53 | 17 | 909 | 336 | 8 | 133 | 24 | 9 | 20 |
| 54 | 17 | 933 | 282 | 6 | 320 | 22 | 20 | 18 |
| 55 | 17 | 923 | 326 | 6 | 208 | 491 | 7 | 17 |

TABLE 4-continued

| | | | | | | | | |
|---|---|---|---|---|---|---|---|---|
| 56 | 17 | 940 | 344 | 5 | 204 | 1.5 | 10 | 7 |
| 57* | 17 | 918 | 292 | 10 | 207 | 24 | 15 | 17 |

| | Microstructure | | | | | Mechanical characteristics | | |
|---|---|---|---|---|---|---|---|---|
| Manufacture No. | B + TM (area %) | Remainder (area %) | Ratio of length of grain boundary having rotation angle in range in range of 55° to 75° (%) | Dislocation density ($10^{15}$ m/m$^2$) | Lath width (nm) | Tensile strength (MPa) | Hydrogen embrittlement resistance | Note |
| 31 | 74 | 3 | 50 | 4.5 | 175 | 2179 | Very Good | Example of invention |
| 32 | 74 | 4 | 45 | 4.7 | 187 | 2079 | Very Good | Example of invention |
| 33 | 70 | 4 | 48 | 6.2 | 167 | 2198 | Very Good | Example of invention |
| 34 | 74 | 3 | 40 | 5.5 | 270 | 1310 | Good | Comparative Example |
| 35 | 73 | 3 | 43 | 6.3 | 166 | 1291 | Good | Comparative Example |
| 36 | 83 | 1 | 58 | 4.5 | 166 | 2398 | Bad | Comparative Example |
| 37 | 64 | 9 | 41 | 6.3 | 187 | 2021 | Bad | Comparative Example |
| 38 | 71 | 3 | 21 | 6.3 | 163 | 2414 | Bad | Comparative Example |
| 39 | 68 | 4 | 48 | 4.7 | 165 | 1280 | Good | Comparative Example |
| 40 | 75 | 1 | 52 | 6.2 | 183 | 1191 | Good | Comparative Example |
| 41 | 74 | 2 | 40 | 5.4 | 182 | 1290 | Good | Comparative Example |
| 42 | 58 | 18 | 46 | 5.5 | 182 | 2042 | Bad | Comparative Example |
| 43 | 73 | 4 | 49 | 5.4 | 186 | 1187 | Good | Comparative Example |
| 44 | 68 | 4 | 43 | 6.0 | 186 | 2104 | Bad | Comparative Example |
| 45 | 76 | 1 | 41 | 5.3 | 166 | 2164 | Bad | Comparative Example |
| 46 | 70 | 2 | 53 | 4.5 | 183 | 2188 | Bad | Comparative Example |
| 47 | 61 | 22 | 53 | 5.5 | 167 | 2146 | Bad | Comparative Example |
| 48 | 67 | 13 | 60 | 5.1 | 192 | 2398 | Bad | Comparative Example |
| 49 | 72 | 9 | 60 | 5.9 | 171 | 2397 | Bad | Comparative Example |
| 50 | 70 | 11 | 53 | 5.2 | 194 | 2328 | Bad | Comparative Example |
| 51 | 75 | 6 | 60 | 6.5 | 173 | 2432 | Bad | Comparative Example |
| 52 | 77 | 4 | 23 | 5.3 | 189 | 2006 | Bad | Comparative Example |
| 53 | 74 | 6 | 58 | 3.3 | 182 | 1466 | Good | Comparative Example |
| 54 | 79 | 3 | 19 | 5.0 | 192 | 2058 | Bad | Comparative Example |
| 55 | 78 | 5 | 50 | 5.4 | 191 | 2414 | Bad | Comparative Example |
| 56 | 91 | 2 | 50 | 5.3 | 181 | 2107 | Bad | Comparative Example |
| 57* | 77 | 6 | 19 | 5.6 | 175 | 2290 | Bad | Comparative Example |

An underline represents that a condition is out of the range of the present invention, a manufacturing condition is not preferred, or characteristicsare not preferred.
*heating and holding before holding at low temperature

INDUSTRIAL APPLICABILITY

According to the aspect of the present invention, it is possible to obtain a hot-stamping formed body that is excellent in strength and hydrogen embrittlement resistance.

The invention claimed is:

1. A hot-stamping formed body comprising, as a chemical composition, by mass %:

C: more than 0.50% and 1.00% or less;
Si: 0.50% to 3.00%;
Mn: more than 3.00% and 5.00% or less;
Al: 0.100% to 3.000%;
Co: 0.100% to 3.000%;
P: 0.100% or less;
S: 0.1000% or less;
N: 0.0100% or less;
Nb: 0% to 0.150%;
Ti: 0% to 0.150%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and
a remainder comprising Fe and impurities; and microstructure which includes residual austenite of which an area ratio is in a range of 20% to 30%, bainite and tempered martensite of which a total area ratio is in a range of 70% to 80%, and a remainder in microstructure of which an area ratio is less than 5%, wherein within a region which has a length of 50 μm and is present between a depth corresponding to ⅛ of a thickness from the surface and a depth corresponding to ⅜ of a thickness from the surface among grain boundaries of crystal grains of the bainite and the tempered martensite, a ratio of a length of a grain boundary having a rotation angle in a range of 55° to 75° to a <011> direction to a total length of a grain boundary having a rotation angle in a range of 4° to 12° to a <011> direction, a grain boundary having a rotation angle in a range of 49° to 54° to a <011> direction, and a grain boundary having a rotation angle in the range of 55° to 75° to the <011> direction is 30% or more.

2. The hot-stamping formed body according to claim 1, further comprising, as the chemical composition, by mass %, at least one selected from the group of:

Nb: 0.010% to 0.150%;
Ti: 0.010% to 0.150%;
Mo: 0.005% to 1.00%;
Cr: 0.005% to 1.00%;
Cu: 0.001% to 1.00%;
V: 0.0005% to 1.00%;
W: 0.001% to 1.00%;
Ni: 0.001% to 3.00%;

Mg: 0.001% to 1.00%;
Zr: 0.001% to 1.00%;
Sb: 0.001% to 1.00%;
Ca: 0.001% to 0.10%;
REM: 0.001% to 0.30%; and
B: 0.0005% to 0.0100%.

* * * * *